US005365695A

United States Patent [19]

Kjellberg

[11] Patent Number: 5,365,695

[45] Date of Patent: Nov. 22, 1994

[54] PARKING PLACE OBSTRUCTION

[76] Inventor: Toivo Kjellberg, Klockarvägen 91, S-151 62 Södertälje, Sweden

[21] Appl. No.: 146,019

[22] PCT Filed: May 8, 1992

[86] PCT No.: PCT/SE92/00301

§ 371 Date: Nov. 9, 1993

§ 102(e) Date: Nov. 9, 1993

[87] PCT Pub. No.: WO92/20867

PCT Pub. Date: Nov. 26, 1992

[30] Foreign Application Priority Data

May 14, 1991 [SE] Sweden ..... 9101447

[51] Int. Cl.[5] ..... E01F 13/00; E06B 11/00

[52] U.S. Cl. ..... 49/49; 49/35; 49/131; 404/6

[58] Field of Search ..... 49/49, 131, 35; 404/6, 404/9

[56] References Cited

U.S. PATENT DOCUMENTS 3,564,769 2/1971 Wilson et al. ..... 49/131 X
3,660,935 5/1972 Boots ..... 49/131 X
4,003,161 1/1977 Collins ..... 49/131 X
4,576,508 3/1986 Dickinson ..... 49/131 X
5,054,237 10/1991 Kapala et al. ..... 49/131 X

FOREIGN PATENT DOCUMENTS 2621625 4/1989 France ..... 49/49

*Primary Examiner*—Philip C. Kannan
*Attorney, Agent, or Firm*—Adduci, Mastriani, Schaumberg & Schill

[57] ABSTRACT

Theft preventing means at a parking lot comprising a hindrance means (10, 30) raisable from a retired position and lockable in a raised position. The hindrance means comprises a tubular part (10) depressed into the ground at the parking lot, and a post (30) telescopically mounted therein. The post (30) has a slot (40) in which a catch (41) is pivotally mounted between an inner position, in which the catch is accommodated within the cross section of the post and an outer position in which the post is prevented from being pushed down in part (10), on the post. An opening (44) is arranged in the catch (41) for receiving the clamp of a padlock.

2 Claims, 1 Drawing Sheet

PARKING PLACE OBSTRUCTION

Figures 1A, 1B:
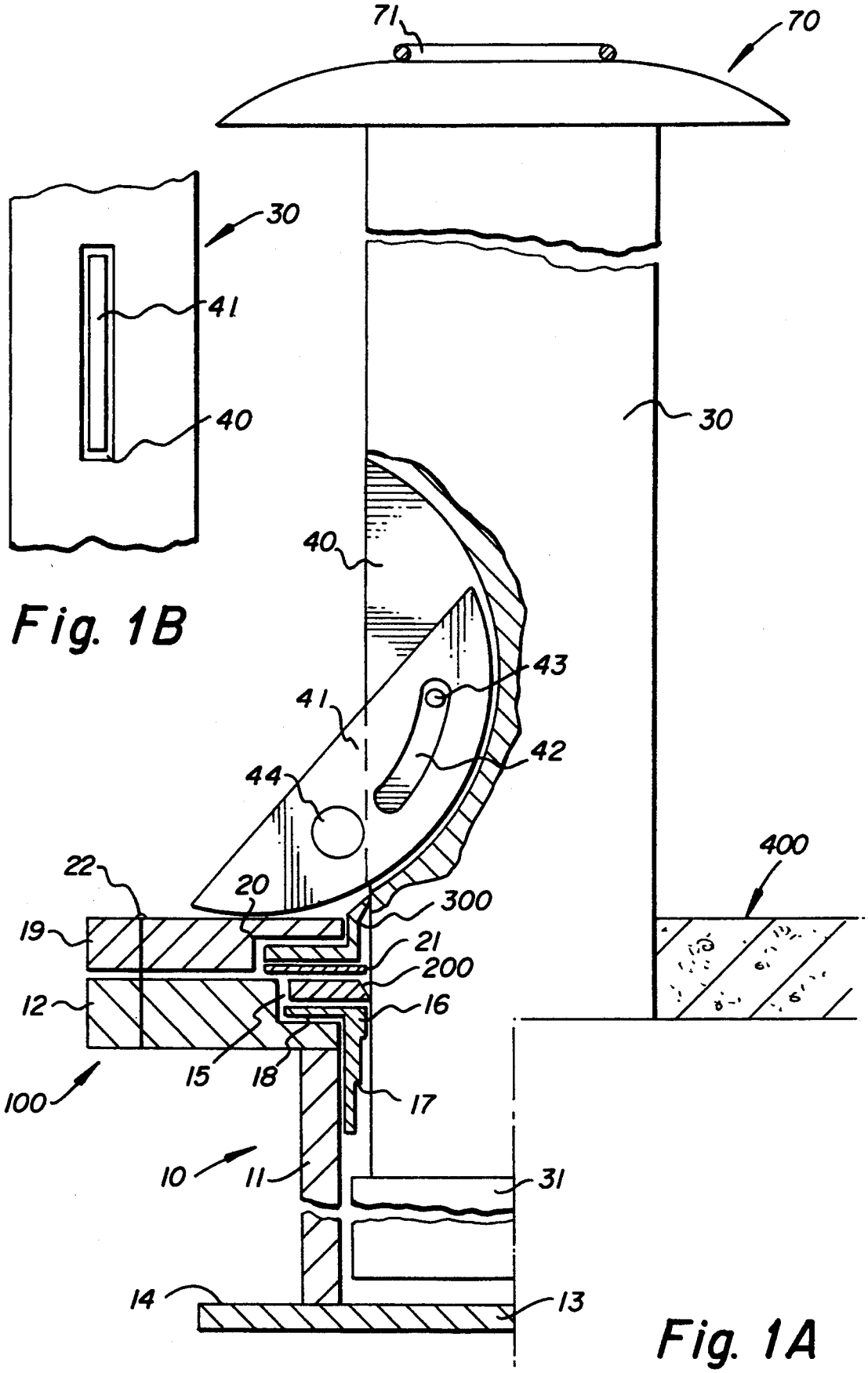

The invention refers to a means according to the preamble of claim 1.

Means of this kind are well known in many embodiments, and are used partly for making it more difficult to or prevent the driving of a car past the raised hindrance means, and partly to prevent unauthorized parking in the parking lot.

One important problem has been the manufacturing of a raisable/removable hindrance means, which is robust, can be manufactured at a low cost, is easy to manipulate and also can be used at extreme weather conditions as in snowy and cold weather.

The object of the invention is accomplished by the means according to the invention as defined in the characterizing part of claim 1.

Embodiments of the invention will be evident from the subclaims and are further described below with reference to the accompanying drawing.

In the drawing, the FIGURE shows an axial, partly cross-sectional view of a hindrance means according to the invention.

The surface of the ground is identified with the reference numeral 400.

A tubular part (10) is mounted in the ground.

Part 10 comprises a sleeve 11 with bottom 13 and a radially projecting bottom flange 14 and a radially projecting upper edge flange 12. The flange 12 comprises a collar 100 which is connected to the sleeve 11.

The flange 12 has a seam 15. In this seam a hindrance means 16 is immersed, which reaches down in the sleeve 11. This hindrance means 16 is turned with a stepped form 17. The hindrance means 16 is connected to the flange 12 through a screw joint 18.

In the seam 15, on top of the hindrance means 16, is mounted a packing box 200.

A packing flange 19 has a seam 20, in which seam a scraper ring 300 is arranged, and underneath the scraper ring a washer 21 is mounted, which holds the scraper ring 300 in place.

The flanges 12,19 are connected to each other through a screw joint 22.

A post 30 made of solid material passes with a slip fit through the packing box 200 and the scraper ring 300 down into the sleeve 11 having a larger inside diameter than the post 30.

A cylindrical guide body 31 is arranged having an outside diameter corresponding to the inner diameter of the sleeve 11 and prevents removal of the post 30 from part 10 by abutting the hindrance means 16.

The sleeve 11 is deep enough for inserting the post therein, whereby the cap 70 on the post will rest on the flange 19 and/or the surface of the ground 400.

The cap 70 can be convex on the upper side and be provided with a lifting means 71, such as a pulling ring, which is immersed in a groove in the cap 70, which pulling ring is provided with a holder acting as a hinge.

The post 30 has an axial slot 40 and a catch 41, which through a groove 42 in the catch 41 is guided by a pin 43, which prevents the catch 41 from sliding completely out of the slot 40.

The catch is retractable into the slot 40 to an inner position, where it is accomodated inside the outer diameter of the post, and it is extendable by its own weight. When the catch 41 has passed the upper part of the scraping ring 300/the surface of the ground 400, the catch falls out under its own weight and rests on the packing flange 19 and the surface of the ground 400, whereby the opening 44 is exposed. A padlock is mounted with its clamp through the opening 44 and prevents depression of the post 30 into the sleeve 10.

The embodiment shown in the drawing has proved to fullfill all practical demands put on a hindrance means, and thereby eliminates all disadvantages and defects associated with previously known embodiments of hindrance means.

I claim:

1. A means at a parking lot having at its front end a barrier and, at its back end, a hindrance means (10,30) which is raisable from a retired position and which is lockable in a raised position, whereby the hindrance means (10,30) comprises a tubular part, which is recessedly mounted in the ground at the parking lot, and a post (30), which is telescopically mounted in said tubular part, which post is connected to a guide body (31) preventing the post (30) from being dragged out of a sleeve (11) by a second hindrance means (16), characterized in that the post (30) comprises a slot (40) wherein a catch (41) is pivotally mounted on the post between an inner position, wherein the catch lies within the cross section of the post, and an outer position in which the catch (41) projects outside said cross section and prevents the post from being pushed down from its raised, locked position, and in that an opening (44) is arranged in the projecting part of the catch (41) in order to receive a padlock clamp.

2. Means according to claim 1, characterized in that the slot (40) is arranged substantially axially in the, preferably solid post (30).

* * * * *